US008302708B1

(12) United States Patent
Cox et al.

(10) Patent No.: US 8,302,708 B1
(45) Date of Patent: Nov. 6, 2012

(54) ROTATIONAL DRILL WRENCHES AND DRILLING APPARATUSES INCLUDING THE SAME

(75) Inventors: E. Sean Cox, Spanish Fork, UT (US); Russell Roy Myers, Provo, UT (US)

(73) Assignee: Dover BMCS Acquisition Corporation, Orem, UT (US)

( * ) Notice: Subject to any disclaimer, the term of this patent is extended or adjusted under 35 U.S.C. 154(b) by 484 days.

(21) Appl. No.: 12/464,737

(22) Filed: May 12, 2009

(51) Int. Cl.
*E21B 3/00* (2006.01)
*E21B 17/02* (2006.01)
*E21B 17/03* (2006.01)
*E21B 3/02* (2006.01)

(52) U.S. Cl. ..... 175/300; 175/320; 408/226; 408/239 A; 81/177.85; 279/14; 279/103; 285/14; 285/390

(58) Field of Classification Search ..... 29/26 A; 81/121.1, 124.3, 177.2, 177.85; 175/300, 175/320, 101, 325.2; 285/14, 390; 403/300, 403/307, 308, 320; 166/242.6; 279/14, 103; 408/239 A, 239, 226, 712, 130; 173/34, 173/36
See application file for complete search history.

(56) References Cited

U.S. PATENT DOCUMENTS

| | | | | |
|---|---|---|---|---|
| 1,509,680 A | | 9/1924 | Meek et al. | |
| 2,676,506 A | | 4/1954 | Schultz | |
| 4,558,976 A | * | 12/1985 | Begluitti | 408/226 |
| 4,564,315 A | | 1/1986 | Rozanc | |
| 4,632,195 A | * | 12/1986 | Emmerich | 175/320 |
| 4,834,594 A | * | 5/1989 | Morgan | 408/239 A |
| 4,907,660 A | * | 3/1990 | Staggs et al. | 175/320 |
| 5,526,720 A | | 6/1996 | Locotos | |
| 5,833,017 A | * | 11/1998 | Woods et al. | 175/320 |
| 6,092,612 A | * | 7/2000 | Brady | 175/325.2 |
| 6,269,717 B1 | * | 8/2001 | Bollinger | 81/177.2 |
| 7,114,418 B1 | * | 10/2006 | Allen | 81/439 |
| 7,185,568 B1 | * | 3/2007 | Vance | 81/177.2 |
| 7,207,400 B2 | * | 4/2007 | Bise et al. | 175/320 |
| 7,900,719 B2 | * | 3/2011 | Yao | 175/320 |
| 2003/0190211 A1 | * | 10/2003 | Bodin | 411/29 |

FOREIGN PATENT DOCUMENTS

DE 0291873 5/1916

* cited by examiner

*Primary Examiner* — Jennifer H Gay
(74) *Attorney, Agent, or Firm* — Advantedge Law Group

(57) ABSTRACT

A drill wrench for driving drill steels, drill bits, and bolts during drilling and bolting operations is disclosed. The drill wrench may include an internal driver for driving a drill steel. The internal driver may be inserted in an internal-drive recess defined within an end of the drill steel. When the drill wrench is rotated, the internal driver may drive the drill steel by engaging at least one surface within the end of the drill steel. The drill wrench may also include an external support member that supports the drill steel during drilling. The external support member may also drive the drill steel by engaging an outer peripheral portion of the drill steel when the drill wrench is rotated.

19 Claims, 6 Drawing Sheets

ROTATIONAL DRILL WRENCHES AND DRILLING APPARATUSES INCLUDING THE SAME

BACKGROUND

Rotational cutting apparatuses are traditionally utilized for a variety of material removal processes, such as machining, cutting, and drilling. For example, tungsten carbide cutting elements have been used for machining metals and, to some degree, on drilling tools for drilling subterranean formations. Similarly, polycrystalline diamond compact (PDC) cutters have been used to machine metals (e.g., non-ferrous metals) and on subterranean drilling tools, such as drill bits, reamers, core bits, and other drilling tools. Other types of cutting elements, such as ceramic (e.g., cubic boron nitride, silicon carbide, and the like) cutting elements or cutting elements formed of other materials have also been utilized for cutting operations.

Drill bits used for drilling solid materials may include drill bit bodies to which cutting elements are attached. The drill bit bodies are often formed of steel or of molded tungsten carbide. In some situations, drill bits employing cutting elements may be used in subterranean mining to drill roof-support holes. For example, in underground mining operations, such as coal mining, tunnels must be formed underground. In order to make the tunnels safe for use, the roofs, floors, and/or ribs of the tunnels must be supported to reduce the chances of a roof cave-in and to shield mine workers from various debris falling from the roof.

In order to support various portions of a mine tunnel, boreholes may be drilled into a roof, floor, and/or rib of the mine tunnel using a drilling apparatus. Bolts may then be inserted into the boreholes to anchor support panels to the desired portions of the mine tunnel. The drilled boreholes may be filled with resin prior to inserting the bolts, or the bolts may have self expanding portions, in order to anchor the bolts. A drilling apparatus used for drilling boreholes may include a drill bit that is attached to a distal end of a drill steel. Conventional drill steels typically have a long shaft extending between the drill bit and a rotational portion of the drilling apparatus. The drill steel may enable drilling of boreholes that are significantly longer than the length of the drill bit alone.

Various constraints, such as limited working spaces in mine tunnels, drilling apparatus limitations, and difficulties associated with transporting relatively long drill steel lengths, may necessitate the use of two or more drill steels to drill a borehole to a sufficient depth. For example, a first drill steel may be used to drill a portion of a borehole. Without removing the drill bit and the first drill steel from the borehole, a second drill steel may be connected to an exposed end of the first drill steel, forming a drill shaft having a length approximating the combined lengths of the first and second drill steels, enabling a longer borehole to be drilled Conventional drill steels may be connected to a drill wrench or chuck of a drilling apparatus. The drill steels may be driven by an external drive mechanism in the drill wrench or chuck. For example, an exterior of a drill steel may have a hexagonal shape designed to fit within a wrench socket having a corresponding hexagonal shape. A drill wrench may be rotated by a chuck that is driven by a power unit. When two or more drill steels are connected to each other during drilling operations, outer surfaces of the drill steels may be exposed to the formation being drilled. The exposed surfaces of the drill steels may be damaged by abrasive surfaces of the formation, causing significant wear to the outer drill steel surfaces. Such wear may reduce the useful life of the drill steels.

For example, hexagonal-shaped outer surfaces of the drill steels may become rounded, making it difficult or impossible to drive the drill steels with a drill wrench or chuck having a hexagonal-shaped socket. Additionally, the worn outer surfaces of the drill steels may cause the drill steels to become caught in the drill wrenches or chucks, making it difficult to remove the drill steels from the drill wrenches or chucks. Problems associated with worn and damaged drill steel surfaces may cause delays in drilling operations. Avoiding such delays may reduce unnecessary downtime and production losses. Avoiding such delays is particularly important during bolting and securement operations in mine tunnels due to various safety hazards present in these environments.

SUMMARY

The instant disclosure is directed to exemplary rotary drill wrenches and rotary drill wrench assemblies for driving drill steels, drill bits, and/or bolts during drilling and bolting operations. In some examples, a drill wrench may comprise a forward end and a rearward end longitudinally opposite the forward end. The drill wrench assembly may also comprise an internal driver for driving a drill steel. The internal driver may be rotatable about a longitudinal axis and shaped to fit in an internal-drive recess defined within an end of the drill steel. In various embodiments, the internal driver may be inserted in the internal-drive recess of the drill steel and rotated about the longitudinal axis. As the driver is rotated about the longitudinal axis, the internal driver may be configured to drive the drill steel by engaging at least one surface within the end of the drill steel that defines at least a portion of the internal-drive recess.

In one example, the drill wrench assembly may also comprise an external support member configured to at least partially surround at least a portion of the drill steel when the internal driver is inserted in the internal-drive recess of the drill steel. The internal driver and the external support member may be configured to simultaneously abut the drill steel when the internal driver is inserted in the internal-drive recess of the drill steel. In some examples, the external support member may be configured to drive the drill steel by engaging an outer peripheral portion of the drill steel when the internal driver is inserted in the internal-drive recess of the drill steel and rotated about the longitudinal axis. In an additional example, the internal driver and the external support member may be configured to cooperatively drive the drill steel when the internal driver is inserted in the internal-drive recess of the drill steel and rotated about the longitudinal axis.

In various examples, the drill wrench assembly may comprise a seat portion adjacent to a rearward end of the internal driver, with the seat portion configured to axially abut the end of the drill steel when the internal driver is inserted in the internal-drive recess of the drill steel. In at least one example, the internal driver may comprise at least one outer peripheral face that extends substantially parallel to the longitudinal axis. A cross-section of the internal driver may comprise a generally hexagonal-shaped outer periphery. In some examples, the internal driver may comprise a threaded outer peripheral surface.

In at least one example, an internal channel may be defined within the internal driver. The internal channel may extend through the internal driver, with the internal channel being configured to open to a corresponding internal channel defined within the drill steel when the internal driver is inserted in the internal-drive recess of the drill steel. Further, the internal channel may extend through the rearward end of the drill wrench.

In various examples, a rotary drilling apparatus may comprise a drill steel, a drill bit coupled to a first end of the drill steel, and a drill wrench coupled to a second end of the drill steel. The drill wrench may comprise an internal driver that is inserted in an internal-drive recess defined within an end of the drill steel. The drill wrench may further comprise a shank extending generally parallel to the longitudinal axis. The shank of the drill wrench may be configured to fit within a coupling recess of a chuck. In at least one example, the drill wrench may comprise an external support member that at least partially surrounds at least a portion of the drill steel.

In some examples, a drill wrench may comprise a forward end and a rearward end longitudinally opposite the forward end. The drill wrench may be rotatable about a longitudinal axis extending between the forward end and the rearward end. The drill wrench may include an internal driver including at least one engagement feature and an external support member including at least one support feature radially surrounding at least a portion of the internal driver. The external support member may define a gap that radially surrounds at least a portion of the internal driver.

In at least one example, the external support member may comprise a first longitudinal section defining a hole within the external support member and a second longitudinal section defining a recess within the external support member, with the recess having a diameter greater than a diameter of the hole defined by the first longitudinal section. In various examples, the external support member may comprise at least one engagement feature. In some examples, the external support member may comprise at least one generally cylindrical internal surface. In various examples, the external support member may comprise at least one internal face that extends substantially parallel to the longitudinal axis. In at least one example, the external support member may be brazed to the drill wrench assembly. In some examples, the external support member may be integrally formed with the internal driver.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
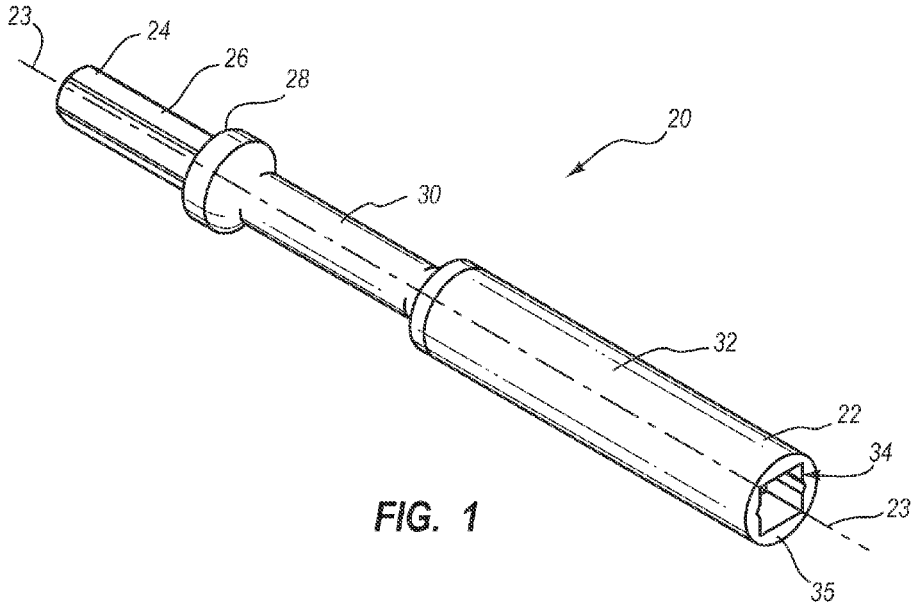
FIG. 1 is perspective view of an exemplary drill wrench according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The instant disclosure is directed to exemplary drill wrenches for rotationally driving drill steels, drill bits, and/or bolts used in drilling operations. For example, a drill steel may be coupled to a drill wrench at one end and may be coupled to a rotary drill bit at a second end. The drill wrenches may be used in any suitable drilling environment, including wet-drilling and/or dry-drilling environments. The drill wrenches may also be used for drilling any suitable material, including, for example, materials in various subterranean formations. The drill wrenches may be configured to rotationally drive various types of drill steels, including, for example drill steels having internal and/or external drive surfaces. The drill wrenches may also be configured to rotationally drive various types of bolts, including, without limitation bolts configured to be driven into boreholes in formations.

For ease of use, the words "including" and "having," as used in this specification and claims, are interchangeable with and have the same meaning as the word "comprising." In addition, the word "cutting" may refer broadly to machining processes, drilling processes, boring processes, or any other material removal process utilizing a cutting element. The word "superhard," as used herein, may refer to any material having a hardness that is at least equal to a hardness of tungsten carbide.

FIGS. 1-3B show an exemplary drill wrench 20 according to at least one embodiment. Drill wrench 20 may represent any type or form of rotational drill wrench for directly and/or indirectly driving drill bits, drill steels, bolts, and/or any other suitable drilling component. Drill wrench 20 may be formed of any suitable material or combination of materials, such as, for example, steel alloy. Drill wrench 20 may be configured to be directly and/or indirectly coupled to a power unit suitable for rotationally driving drill wrench 20. Power units may include any suitable apparatus capable of generating and/or transferring force to drill wrench 20 to rotationally drive drill wrench 20.

In some examples, drill wrench 20 may be configured to be coupled to a chuck that is rotationally driven by a power unit. In additional examples, drill wrench 20 may be integrally formed with and/or may comprise a drill chuck. For example a drill wrench that is integrally formed with a drill chuck may be configured to be rotationally mounted to a drilling apparatus. An inner portion of such an integrally formed drill wrench and chuck may be configured to be coupled with various drilling components, such as drill steels and bolts, and an outer portion may be configured to be driven by a power unit.

As illustrated FIG. 1, drill wrench 20 may comprise a forward end 22 and a rearward end 24 longitudinally opposite the forward end. Drill wrench 20 may be configured to be rotated about a longitudinal axis 23 extending between forward end 22 and rearward end 24. In various embodiments, a rearward portion of drill wrench 20 may comprise a shank 26 and a shoulder 28 adjacent to shank 26. A forward portion of drill wrench 20 may include an external support member 32 comprising a wrench opening 34 that may be at least partially defined by a forward face 35. In some embodiments, drill wrench 20 may also include an extension portion 30.

Figure 2:
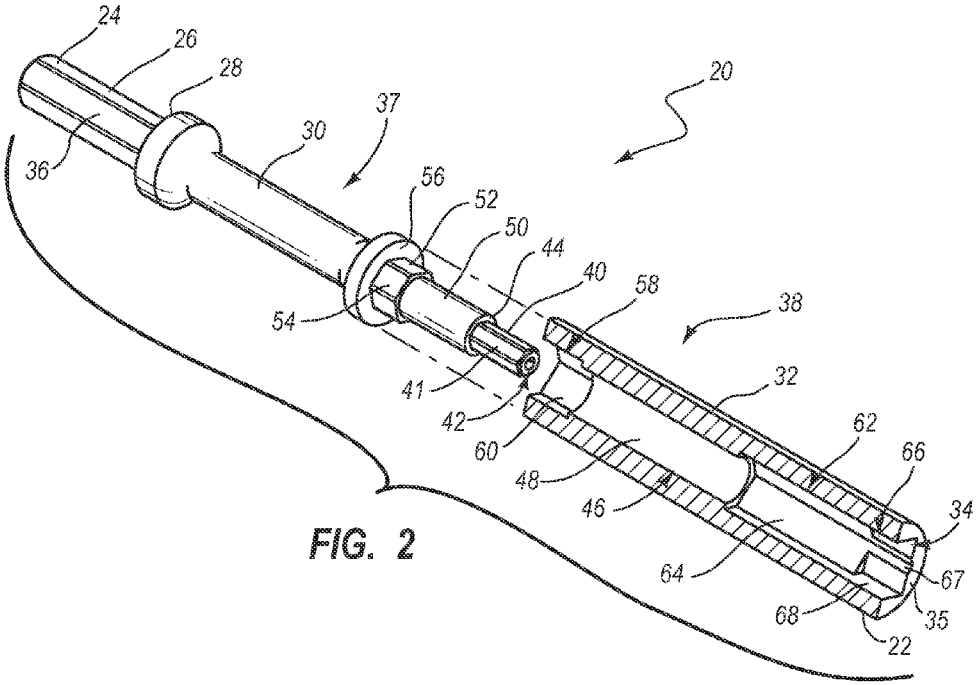
FIG. 2 is a partial cross-sectional exploded perspective view of the exemplary drill wrench illustrated in FIG. 1.
Figure 3A:
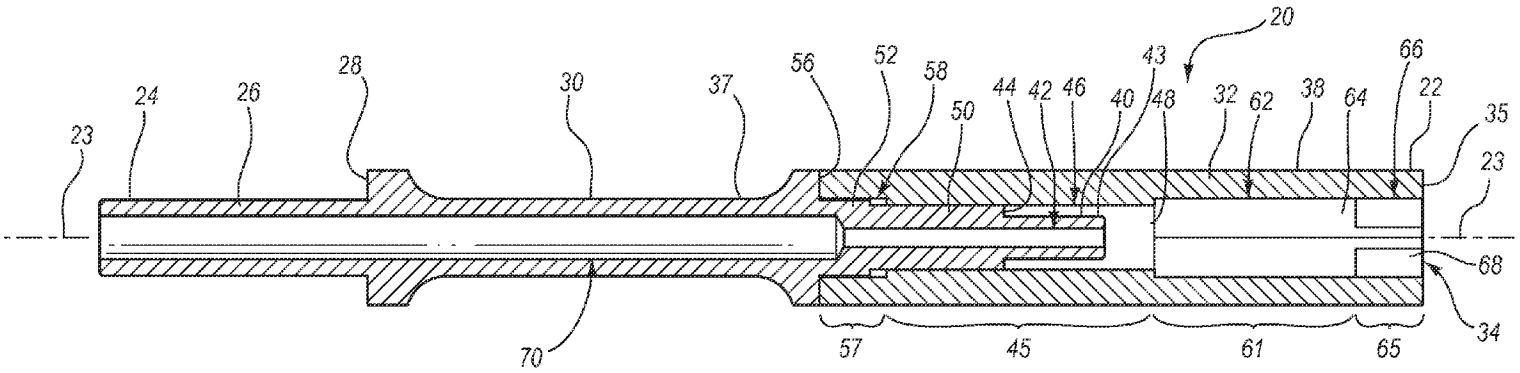
FIG. 3A is a cross-sectional side view of the exemplary drill wrench illustrated in FIG. 1.

Drill wrench 20 may comprise any suitable configuration of one or more components coupled and/or secured together to form an internal and/or an external drive mechanism. For example, drill wrench 20 may comprise a single, integrally-formed unit comprising an internal and/or an external drive mechanism. According to various embodiments, drill wrench 20 may comprise two or more distinct components that are coupled and/or secured together, as illustrated in FIGS. 2 and 3A. For example, drill wrench 20 may include an internal component 37 comprising an internal drive mechanism and an external component 38 comprising an external drive mechanism. In some examples, an internal drive mechanism may include, without limitation, an internal driver 40, as illustrated in FIG. 2. In various embodiments, an external drive mechanism may include, for example, an external support section 45 and one or more external drive sections, as illustrated in FIG. 3A.

According to at least one embodiment, internal component 37 may include shank 26, shoulder 28, and extension portion 30. As illustrated in FIG. 3A, shank 26 may be integrally formed with shoulder 28, extension portion 30, and/or any other suitable portion of drill wrench 20. In additional embodiments, shank 26 and/or shoulder 28 may be coupled to extension portion 30 and/or any other portion of drill wrench 20 using any suitable attachment means, without limitation. For example, shank 26 and/or shoulder 28 may be brazed, welded, soldered, threadedly coupled, and/or otherwise adhered and/or fastened to extension portion 30 and/or any other suitable portion of drill wrench 20.

In various embodiments, an outer peripheral surface of shank 26 may include one or more outer peripheral faces 36 extending in a generally longitudinal direction. For example, one or more peripheral faces 36 may extend substantially parallel to longitudinal axis 23. In at least one example, a cross-section of shank 26 may have a generally hexagonal-shaped outer periphery formed by six peripheral faces 36. In some examples, one or more peripheral faces 36 may be formed so that they are not parallel to longitudinal axis 23.

In various embodiments, shank 26 may comprise any shape suitable for coupling with and/or being driven rotationally about longitudinal axis 23 by a rotational member, such as a rotational drill chuck. For example, a cross-section of shank 26 may comprise an outer periphery having any suitable coupling and/or engagement shape, such as, for example, a generally geometric-shaped outer periphery, a generally polygonal-shaped outer periphery (e.g., a hexagonal or square shape), an uneven-shaped outer periphery, and/or a non-circular outer periphery, without limitation. In various embodiments, an exterior of shank 26 may comprise a threaded outer peripheral surface configured to be coupled with a drill chuck having a corresponding threaded inner surface.

Shoulder 28 may be positioned adjacent to an axially forward end of shank 26. Shoulder 28 may have an outer diameter greater than an outer diameter of shank 26. In some embodiments, shoulder 28 may comprise a face extending radially outward relative to drill wrench 20. In some examples, shoulder 28 may abut a forward portion of a rotational member, such as a drill chuck, when drill wrench 20 is coupled to the rotational member. For example, shank 26 may be inserted in a corresponding recess in a drill chuck, and a forward face of the drill chuck may abut shoulder 28. The drill chuck may exert force against shoulder 28 in a generally forward direction during drilling, causing drill wrench 20 to exert a generally forward force against a drill steel and/or a drill bit. In some examples, a rearward end of shank 26 may be configured to contact a corresponding internal surface of a rotational member to which shank 26 is mounted. Accordingly, a rotational member, such as a drill chuck, may also exert force against the rearward end of shank 26 in a generally forward direction during drilling.

Internal component 37 may be configured to be coupled with external component 38. For example, internal component 37 may comprise a shoulder 56, an internal coupling portion 52, and/or an internal abutment portion 50 for coupling and/or securing internal component 37 to external component 38. Internal component 37 may also comprise an internal driver 40 shaped to fit in an internal-drive recess defined within an end of a drill steel coupled to drill wrench 20, as will be explained in greater detail below.

Figure 3B:
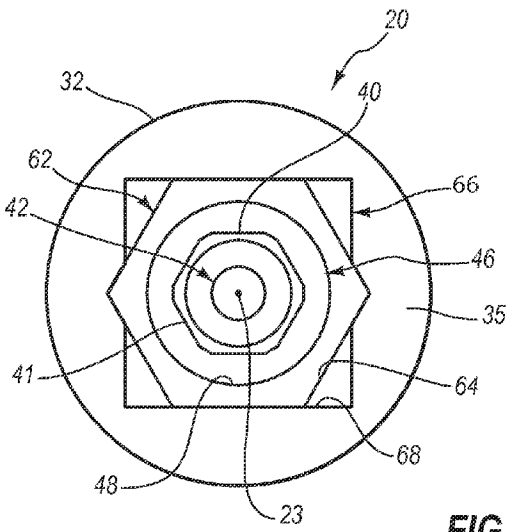
FIG. 3B is a front view of the exemplary drill wrench illustrated in FIG. 1, as viewed facing a forward end of the drill wrench.

Internal driver 40 may be configured to internally drive a drill steel when internal driver 40 is rotated about longitudinal axis 23. In various embodiments, an outer peripheral surface of internal driver 40 may include one or more engagement features, such as outer peripheral faces 41, extending in a generally longitudinal direction. In at least one example, a cross-section of internal driver 40 may have a generally hexagonal-shaped outer periphery formed by six peripheral faces 41, as illustrated in FIG. 3B. A cross-section of internal driver 40 may also comprise an outer periphery having any suitable coupling and/or engagement shape, such as, for example, a generally geometric-shaped outer periphery, a generally polygonal-shaped outer periphery, an uneven-shaped outer periphery, and/or a non-circular outer periphery, without limitation. In various embodiments, internal driver 40 may comprise a threaded outer peripheral surface configured to be coupled with a drill steel having a corresponding threaded inner surface.

External component 38 may comprise one or more sections configured to be coupled with internal component 37. For example, as shown in FIG. 3A, external support member 32 of external component 38 may comprise an external coupling section 57 and an external support section 45. External coupling section 57 and external support section 45 may comprise longitudinal sections of external support member 32. External coupling section 57 may comprise internal surface portions that define an external coupling recess 58 within external support member 32.

External support section 45 may comprise one or more support features, such as internal surface portions that define an external support hole 46 within external support member 32. For example, external support section 45 may comprise a generally cylindrical surface 48 at least partially defining external support hole 46. In some examples, external support hole 46 may comprise a through-hole extending between external coupling section 57 and a forward portion of external support member 32, such as external drive section 61. In some embodiments, external support section 45 may comprise one or more engagement features configured to rotationally engage internal abutment portion 50 and/or a drill steel coupled to drill wrench 20. For example, external support section 45 may comprise a generally geometric-shaped inner periphery, a generally polygonal-shaped inner periphery, an uneven-shaped inner periphery, a non-circular inner periphery, and/or a threaded inner surface, without limitation.

When internal component 37 and external component 38 are coupled together, a rearward end of external support member 32 may abut shoulder 56, as illustrated in FIG. 3A. Additionally, external coupling section 57 of external support member 32 may surround and/or abut at least a portion of internal coupling portion 52. According to at least one embodiment, internal coupling portion 52 and external coupling section 57 may be shaped such that internal component 37 and external component 38 are prevented from rotating and/or shifting relative to each other. Accordingly, internal component 37 and external component 38 may rotate simultaneously with each other when drill wrench 20 is driven. In various embodiments, an outer peripheral surface of internal coupling portion 52 may include one or more engagement features, such as peripheral faces 54, as illustrated in FIG. 2. Likewise, an internal surface of external coupling section 57 may include one or more engagement features, such as internal faces 60 in FIG. 2, corresponding to peripheral faces 54.

In at least one example, a cross-section of internal coupling portion 52 may have a generally hexagonal-shaped outer periphery formed by six peripheral faces 54, and a cross-section of external coupling section 57 may have a generally hexagonal-shaped inner periphery formed by six internal faces 60 corresponding to the six peripheral faces 54. In various embodiments, internal coupling portion 52 and external coupling section 57 may comprise any other shapes suitable for coupling with each other and/or preventing rotation of internal coupling portion 52 and external coupling section 57 relative to each other, without limitation. For example, a cross-section of internal coupling portion 52 may comprise an outer periphery having a non-circular shape and a cross-section of external coupling section 57 may comprise an inner periphery having a corresponding non-circular shape.

In various embodiments, when external component 38 and internal component 37 are coupled together, internal abutment portion 50 may be disposed in external support hole 46 defined within external support section 45. Internal abutment portion 50 may abut at least a portion of external support section 45, further securing external component 38 to internal component 37. Internal abutment portion 50 may comprise any suitable external shape corresponding to an internal surface of external support section 45, without limitation. For example, as illustrated in FIGS. 2 and 3A, internal abutment portion 50 may have a generally cylindrical outer peripheral surface corresponding to a generally cylindrical inner peripheral surface of external support section 45. In some embodiments, a cross-section of internal abutment portion 50 may have an outer periphery comprising any suitable coupling and/or engagement shape, such as, for example, a generally geometric-shaped outer periphery, a generally polygonal-shaped outer periphery, an uneven-shaped outer periphery, and/or a non-circular outer periphery, without limitation. In various embodiments, an exterior of internal abutment portion 50 may comprise a threaded outer surface.

Internal component 37 may be secured to external component 38 using any suitable attachment means, without limitation. For example, internal component 37 may be brazed, welded, soldered, threadedly coupled, and/or otherwise adhered and/or fastened to external component 38. In at least one embodiment, internal component 37 may be brazed to external component using a suitable braze filler material, including, for example, an alloy comprising silver, tin, zinc, copper, and/or any other suitable metals compounds.

One or more braze joints may be formed between any suitable adjacent to portions of internal component 37 and external component 38. For example, one or more braze joints may be formed between a rearward end of external-support member 32 and shoulder 56, between external coupling section 57 and internal coupling portion 52, and/or between external support section 45 and internal abutment portion 50. In additional examples, internal component 37 may be attached to external component 38 using adhesive compounds and/or mechanical fastening techniques. For example, internal component 37 and external component 38 may comprise corresponding threaded portions, enabling internal component 37 and external component 38 to be threadedly secured to each other. In at least one embodiment, internal component 37 may be releasably coupled to external component 38.

As illustrated in FIGS. 3A and 3B, when internal component 37 and external component 38 are coupled together, external support section 45 of external support member 32 may at least partially surround internal driver 40. In at least one example, a gap may be defined between internal driver 40 and external support section 45, with the gap radially surrounding at least a portion of internal driver 40. The gap radially surrounding internal driver 40 may be sized to accommodate an end portion of a drill steel, as will be described in greater detail below with reference to FIG. 6. Accordingly, an end portion of a drill steel may fit around at least a portion of internal driver 40, thereby coupling the drill steel to drill wrench 20. In various embodiments, internal driver 40 may be substantially centered within at least a portion of external support hole 46 defined by external support section 45. Internal component 37 may additionally comprise a seat portion 44 located adjacent to a rearward portion of internal driver 40. In this example, a drill steel may be inserted into external support section 45 of drill wrench 20 until a rearward end of the drill steel may be adjacent to or abut seat portion 44.

FIGS. 2, 3A, and 3B further illustrate various portions of drill wrench 20 that may be configured to externally drive various drill steels and/or bolts. In at least one embodiment, drill wrench 20 may include an external drive section 61 located adjacent to a forward end of external support section 45. Drill wrench 20 may also include an external drive section 65 located adjacent to a forward end of external drive section 61. In some embodiments, drill wrench 20 may also include additional external drive sections having varying diameters and/or shapes.

External drive section 61 and external drive section 65 may comprise longitudinal sections of external support member 32 that are configured to externally drive various components, such as drill steels and/or bolts, as drill wrench 20 is rotated about longitudinal axis 23. External drive section 61 and external drive section 65 may be located adjacent to forward end 22 of drill wrench 20. External drive section 61 may extend longitudinally between external support section 45 and a rearward end of external drive section 65, and external drive section 65 may extend between external drive section 61 and forward face 35.

External drive section 61 may comprise internal surface portions that define an external-drive recess 62 within external support member 32. Likewise, external drive section 65 may comprise internal surface portions that define an external-drive recess 66 within external support member 32. In some embodiments, at least a portion of internal driver 40 may be radially surrounded by at least a portion of external drive section 61 and/or external drive section 65. External-drive recess 62 and/or external-drive recess 66 may have a diameter greater than a diameter of external support hole 46 defined by external support section 45. Accordingly, external drive section 61 and/or external drive section 65 may be configured to abut and/or engage drill steels and/or bolts having outer diameters that are greater than the outer diameters of drill steels that are capable of fitting within external support hole 46. External drive section 61 and external drive section 65 may each comprise any shape suitable for coupling with and/or externally driving a rotational member, such as a drill steel and/or a bolt.

In some examples, external drive section 61 may include one or more engagement features, such as internal faces 64, extending in a generally longitudinal direction. In at least one embodiment, a cross-section of external drive section 61 may have a generally hexagonal-shaped inner periphery formed by six internal faces 64. In various embodiments, a cross-section of external drive section 61 may comprise an inner periphery having any suitable coupling and/or engagement shape, such as, for example, a generally geometric-shaped inner periphery, a generally polygonal-shaped inner periphery (e.g., a hexagonal or square shape), an uneven-shaped inner periphery, and/or a non-circular inner periphery, without limitation. In various embodiments, an interior of external drive section 61 may comprise a threaded inner surface configured to be coupled with a drill steel having a corresponding threaded outer surface.

External drive section 65 may include one or more engagement features, such as internal faces 68, extending in a generally longitudinal direction. In at least one embodiment, external drive section 65 may be configured to drive a bolt having a square bolt head. Accordingly, a cross-section of external drive section 65 may comprise a generally square-shaped inner periphery formed by four internal faces 68. As illustrated in FIG. 2, one or more of internal faces 68 may be intersected by an indentation 67 defined within external drive section 65. Indentation 67 may be shaped to facilitate coupling between drill wrench 20 and a drill steel having a hexagonal-shaped external periphery configured to be externally driven by external drive section 65. In various embodiments, a cross-section of external drive section 65 may comprise an inner periphery having any suitable coupling and/or engagement shape, without limitation. In at least one embodiment, an interior of external drive section 65 may comprise a threaded inner surface configured to be coupled with a drill steel having a corresponding threaded outer surface.

According to at least one embodiment, a channel 42 may be defined within internal driver 40. In some examples, channel 42 may extend longitudinally through internal driver 40, from the forward end of internal driver 40 to rearward end 24 of drill wrench 20. In various examples, channel 42 may be open to a channel 70 defined within internal component 37. Channel 70 may extend longitudinally through internal component 37 to the rearward end of shank 26.

Channel 42 and channel 70 may be configured to convey various fluids and/or solids through drill wrench 20. For example, in wet-drilling environments, channel 42 and channel 70 may be configured to convey drilling fluid in a forward direction through drill wrench 20. A rearward end of channel 70 may be open to a pressurized drilling fluid source connected directly or indirectly to drill wrench 20. When internal driver 40 is connected to a drill steel, channel 42 in internal driver 40 may be configured to open to a corresponding channel defined within the drill steel. The internal channel defined within the drill steel may extend from a rearward end to a forward end of the drill steel. In some examples, the forward end of the drill steel may be coupled to a drill bit having one or more channels for conveying drilling fluid from the drill steel to cutting surfaces of the drill bit. The drilling fluid may facilitate cutting and debris removal. The drilling fluid may also cool the cutting surfaces during drilling.

In various embodiments, drill wrench 20 may also be used in dry-drilling environments. In dry-drilling environments, channel 42 and channel 70 may be configured to convey drilling debris and/or various fluids, such as air, in a rearward direction through drill wrench 20. A rearward end of channel 70 may be open to a vacuum source connected directly or indirectly to drill wrench 20. As described above, a channel may extend through a drill steel coupled to internal driver 40. A drill bit attached to the drill steel may include a vacuum channel configured to draw debris and air over and away from cutting surfaces of the drill bit, thereby cooling the cutting surfaces and clearing debris from the cutting area.

Figure 4A:
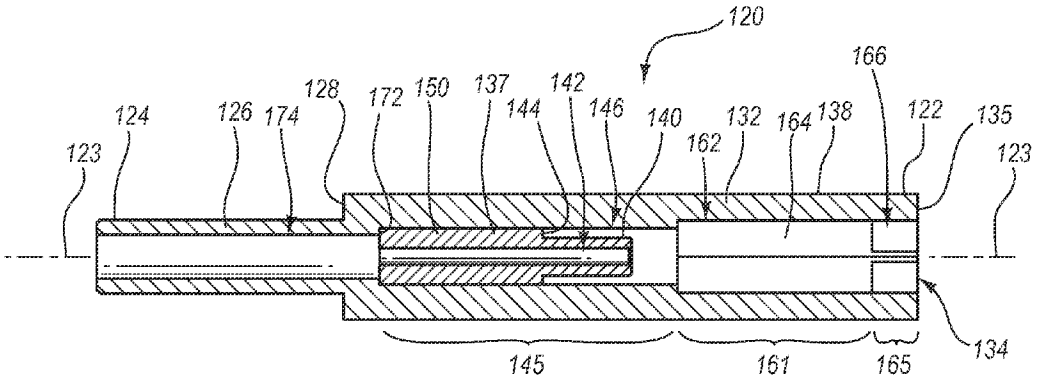
FIG. 4A is a cross-sectional side view of an exemplary drill wrench according to various embodiments.
Figure 4B:
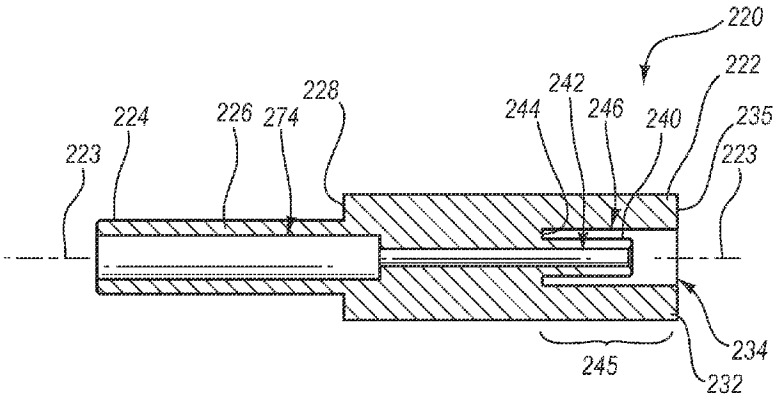
FIG. 4B is a cross-sectional side view of an exemplary drill wrench according to at least one embodiment.

FIGS. 4A and 4B are cross-sectional side views of exemplary drill wrenches according to various embodiments. As illustrated in FIG. 4A, drill wrench 120 may have a forward end 122, a rearward end 124, and a longitudinal axis 123. Drill wrench 120 may comprise an internal component 137 coupled with an external component 138. In at least one embodiment, internal component 137 may be disposed entirely within an external support hole 146 defined within external component 138. Internal component 137 may further comprise an internal abutment portion 150, an internal driver 140, a seat portion 144 located adjacent to a rearward portion of internal driver 140, and a channel 142 extending longitudinally through internal component 137.

According to various embodiments, external component 138 may comprise a shank 126 located at the rearward end of drill wrench 120. Shank 126 may be formed integrally with and/or attached to external component 138 using any suitable attachment means, without limitation. A longitudinally extending channel 174 may be defined within shank 126. External component 138 may also comprise a shoulder 128 adjacent to an axially forward end of shank 126. External component 138 may further comprise an external support member 132 extending between shoulder 128 and forward end 122 of drill wrench 120. External support member 132 may comprise a wrench opening 134 that may be at least partially defined by a forward face 135. In at least one embodiment, external support member 132 may comprise an external support section 145, an external drive section 161, and an external drive section 165. External support section 145, external drive section 161, and external drive section 165 may comprise longitudinal sections of external support member 132.

External support section 145 may comprise internal surface portions that define an external support hole 146 within external support member 132. In some examples, external support hole 146 may comprise a through-hole extending longitudinally between external drive section 161 and a rearward portion of drill wrench 120, such as channel 174. External drive section 161 may comprise internal surface portions that define an external-drive recess 162 within external support member 132, such as, for example, internal faces 164. Likewise, external drive section 165 may comprise internal surface portions that define an external-drive recess 166 within external support member 132.

A seat portion 172 may be defined within external component 138 adjacent to an axially rearward end of external support hole 146. As illustrated in FIG. 4A, the rearward end of internal component 137 may abut seat portion 172. Internal component 137 may be secured within external component 138 using any suitable attachment means, without limitation. For example, internal component 137 may be brazed, welded, soldered, threadedly coupled, and/or otherwise adhered and/or fastened to external component 138. In various embodiments, internal component 137 may be releasably coupled to external component 138, enabling drill wrench to be used either with or without internal driver 140, providing a user with an option to either drive a drill steel both internally and externally with internal drive 140 and external support hole 146, or to drive the drill steel externally only by removing internal component 137 prior to drilling.

FIG. 4B shows a drill wrench 220 according to various embodiments. As illustrated in FIG. 4B, drill wrench 220 may comprise an integrally formed wrench having a forward end 222, a rearward end 224, and a longitudinal axis 223. Drill wrench 220 may comprise an external support member 232 integrally formed with an internal driver 240. A seat portion 244 may be located adjacent to a rearward portion of internal driver 240. In various embodiments, longitudinally extending channels 242 and 274 may be defined within drill wrench 220. According to various embodiments, drill wrench 220 may comprise a shank 226 located at the rearward end of drill wrench 220. Shank 226 may also be formed integrally with external support member 232 and/or internal driver 240. In some examples, drill wrench 220 may comprise a shoulder 228 adjacent to an axially forward end of shank 226.

According to at least one embodiment, drill wrench 220 may also comprise an external support member 232 radially surrounding at least a portion of internal driver 240. External support member 232 may comprise a wrench opening 234 that may be at least partially defined by a forward face 235 of drill wrench 220. In at least one embodiment, external support member 232 may comprise an external support section 245. External support member 232 may also include one or more additional drive sections (e.g., external drive section 161 and external drive section 165 illustrated in FIG. 4A). External support section 245 may comprise a longitudinal section of drill wrench 220. In some examples, external support section 245 may comprise internal surface portions that define an external support hole 246 within external support member 232.

Figure 5B:
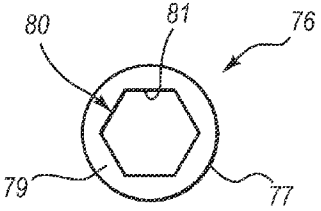
FIG. 5B is a front view of the exemplary drill steel illustrated in FIG. 5A, as viewed facing a rearward end of the drill steel.
Figure 5A:
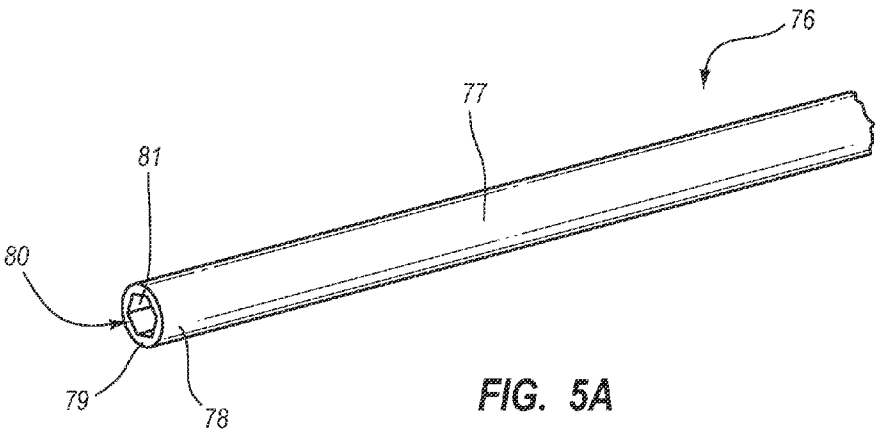
FIG. 5A is a perspective view of an end portion of an exemplary drill steel according to at least one embodiment.
Figure 9:
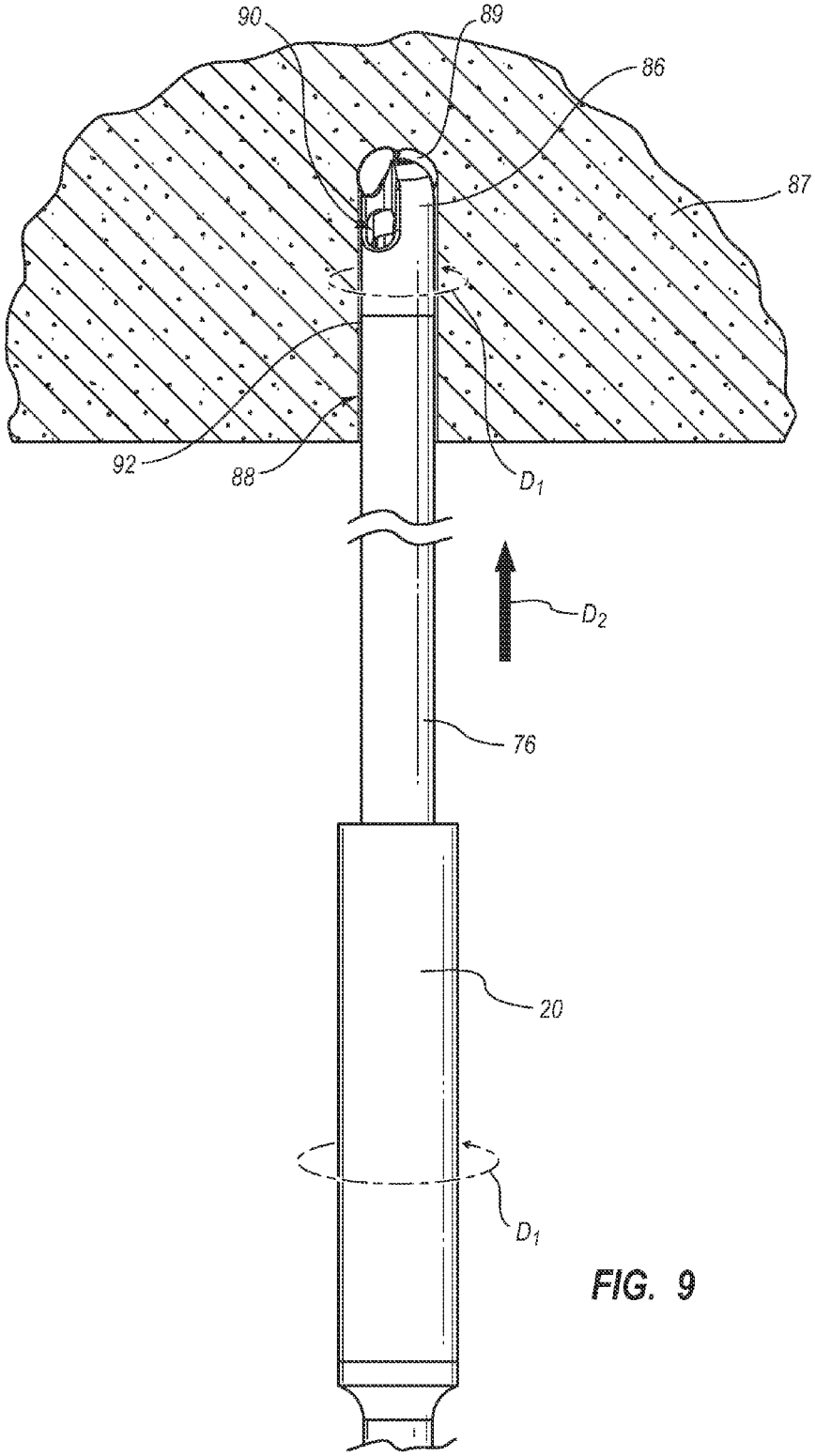
FIG. 9 is a side view of a portion of an exemplary drill apparatus including a drill wrench, a drill steel, and a drill bit that are rotated relative to a formation.

FIG. 5A is a perspective view of an end portion of an exemplary drill steel 76 according to at least one embodiment. FIG. 5B shows the drill steel 76 illustrated in FIG. 5A, as viewed facing a rearward face 79 of drill steel 76. Drill steel 76 may be formed of any suitable material or combination of materials, such as, for example, steel alloy. As shown in FIGS. 5A and 5B, drill steel 76 may comprise a shaft portion 77 extending longitudinally to a rearward end 78. Shaft portion 77 may comprise any suitable length and diameter, without limitation. Rearward end 78 refers to an end of drill steel 76 configured to be coupled to a drill wrench, such as drill wrench 20. A forward end of drill steel 76 located longitudinally opposite rearward end 78 may be configured to be coupled to a drill bit (as illustrated in FIG. 9) and/or to another drill steel. Rearward end 78 of drill steel 76 may comprise a rearward face 79. Drill steel 76 may comprise internal surface portions that define an internal-drive recess 80 in rearward end 78.

An inner surface of drill steel 76 may include one or more internal faces 81 extending in a generally longitudinal direction. At least a portion of internal faces 81 may define internal drive recess 80 within rearward end 78 of drill steel 76. In at least one example, a cross-section of rearward end 78 of drill steel 76 may comprise a generally circular-shaped outer periphery and a generally hexagonal-shaped inner periphery that is defined by six internal faces 81, as illustrated in FIG. 5B. In various embodiments, a cross-section of rearward end 78 of drill steel 76 may comprise an inner periphery having any suitable coupling and/or engagement shape, such as, for example, a generally geometric-shaped inner periphery, a generally polygonal-shaped inner periphery (e.g., a hexagonal or square shape), an uneven-shaped inner periphery, and/or a non-circular inner periphery, without limitation. In some embodiments, an interior of rearward end 78 may comprise a threaded inner surface.

An outer periphery of rearward end 78 of drill steel 76 may also comprise any shape suitable for coupling with and/or being externally driven by a rotational member, such as drill wrench 20, without limitation. For example, a cross-section of rearward end 78 of drill steel 76 may comprise any suitable coupling and/or engagement shape, such as, for example, a generally geometric-shaped outer periphery, a generally polygonal-shaped outer periphery, an uneven-shaped outer periphery, and/or a non-circular outer periphery, without limitation. In some embodiments, an exterior of rearward end 78 may comprise a threaded outer surface.

Figure 6:
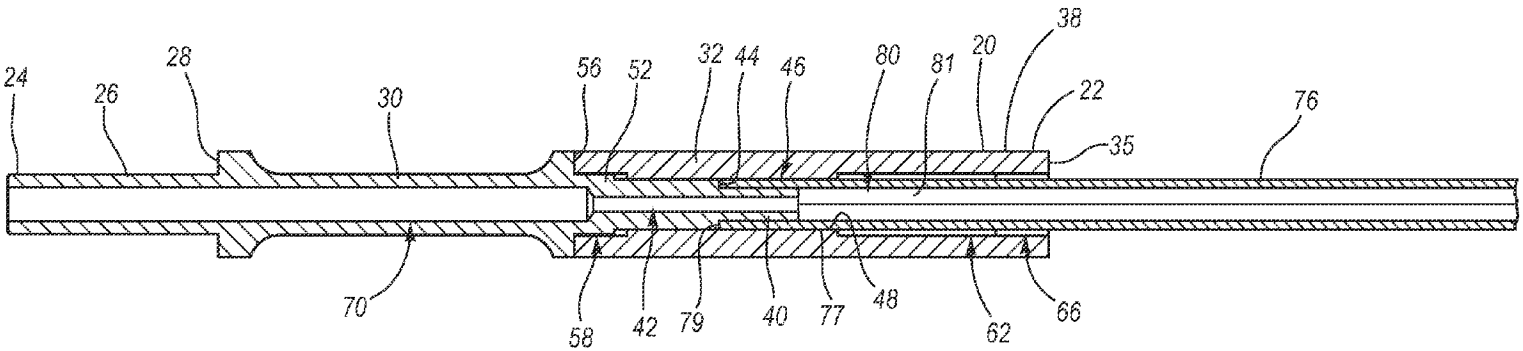
FIG. 6 is a cross-sectional side view of the exemplary drill wrench illustrated in FIG. 3A coupled to the exemplary drill steel illustrated in FIG. 5A.

FIG. 6 is a cross-sectional side view of the exemplary drill wrench 20 illustrated in FIG. 3A coupled to the exemplary drill steel 76 illustrated in FIG. 5A. As shown in FIG. 6, a rearward end of drill steel 76 may be coupled to drill wrench 20. According to at least one embodiment, when drill steel 76 is coupled to drill wrench 20, internal driver 40 may be at least partially inserted in internal-drive recess 80 of drill steel 76. Internal driver 40 may abut at least a portion of drill steel 76 when internal driver 40 is inserted in internal-drive recess 80. In various embodiments, seat portion 44 of drill wrench 20 may axially abut rearward face 79 of drill steel 76. In at least one embodiment, seat portion 44 of drill wrench 20 may exert force against rearward face 79 of drill steel 76 in a generally forward direction during drilling.

In some embodiments, internal driver 40 may comprise an external shape 43 suitable for internally engaging and/or driving drill steel 76, such as a generally geometric-shaped outer periphery, a generally polygonal-shaped outer periphery, an uneven-shaped outer periphery, a non-circular outer periphery, and/or a threaded outer surface, without limitation. For example, a cross-section of internal driver 40 may have a generally hexagonal-shaped outer periphery corresponding with a hexagonal-shaped inner periphery of drill steel 76. Accordingly, when drill wrench 20, and likewise internal driver 40, is rotated about longitudinal axis 23, internal driver 40 may internally drive drill steel 76 by engaging at least one surface within rearward end 78 of drill steel 76. The internal surfaces defining internal-drive recess 80 within drill steel 76 may not be exposed to a formation during drilling. Accordingly, the internal surfaces within drill steel 76 that are engaged and driven by internal driver 40 may not be subject to wear resulting from exposure to formations during drilling. In addition, a drill steel 76 having a generally cylindrical outer peripheral surface may be inhibited or prevented from becoming caught in drill wrench 20, even after drill steel 76 has been subjected to wear during drilling.

In at least one embodiment, when internal driver 40 is inserted in internal-drive recess 80 of drill steel 76, at least a portion of drill steel 76 may be disposed between internal driver 40 and external support section 45 (as illustrated in FIG. 3A) of external support member 32. In some embodiments, internal driver 40 and external support section 45 may cooperate to engage drill steel 76. External support section 45 may provide support to internal driver 40 and/or drill steel 76 as internal driver 40 rotationally drives drill steel 76 during a drilling operation. In at least one embodiment, the support provided by external support member may protect internal driver 40 from damage and failure resulting from bending loads encountered during drilling operations. For example, external support section 45 may inhibit or prevent a bending moment from being transmitted from drill steel 76 to internal driver 40, thereby inhibiting or preventing damage to internal driver 40.

In some examples, external support section 45 (as illustrated in FIG. 3A) of drill wrench 20 may also comprise a shape suitable for externally engaging and/or driving rearward end 78 of drill steel 76, such as a generally geometric-shaped inner periphery, a generally polygonal-shaped inner periphery, an uneven-shaped inner periphery, a non-circular inner periphery, and/or a threaded inner surface, without limitation. For example, a cross-section of external support section 45 may comprise a hexagonal-shaped inner periphery configured to drive a hexagonal-shaped outer periphery of rearward end 78 of drill steel 76 when drill wrench 20 is rotated about longitudinal axis 23. Accordingly, internal driver 40 and external support section 45 of external support member 32 may be configured to simultaneously or cooperatively drive the drill steel when drill wrench 20 is rotated about longitudinal axis 23.

Figure 7B:
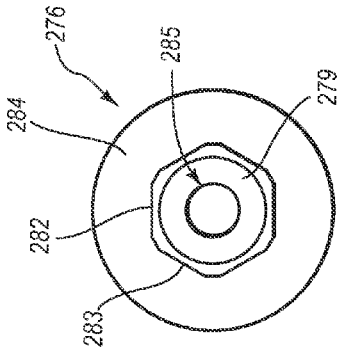
FIG. 7B is a front view of the exemplary drill steel illustrated in FIG. 7A, as viewed facing a rearward end of the drill steel.
Figure 7A:
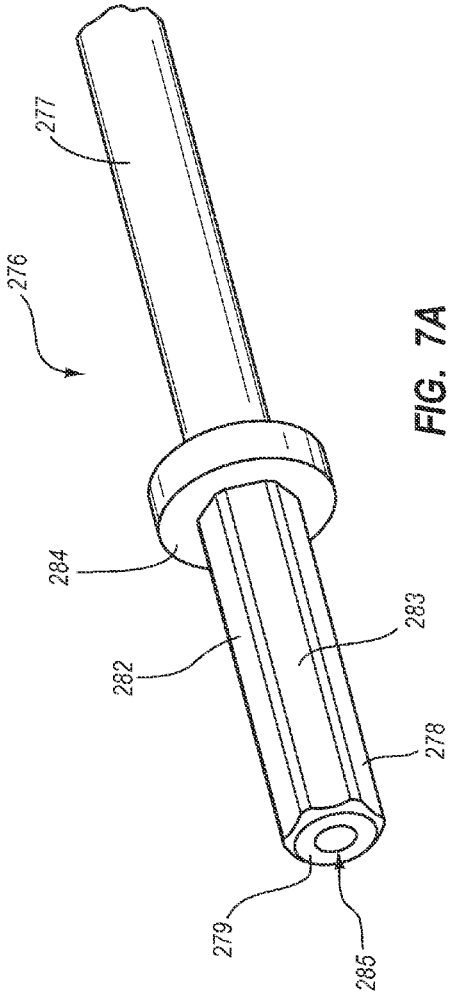
FIG. 7A is a perspective view of an end portion of a drill steel according to various embodiments.

FIG. 7A is a perspective view of an end portion of a drill steel 276 according to various embodiments. FIG. 7B shows the drill steel 276 illustrated in FIG. 7A, as viewed facing a rearward face 279 of drill steel 276. Drill steel 276 may be configured to be externally driven. A rearward end 278 of drill steel 276 may have a diameter that is greater than a diameter of rearward end 78 of drill steel 76. As shown in FIGS. 7A and 7B, drill steel 276 may comprise an external-drive shank 282 at a rearward end 278. Drill steel 276 may also comprise a shoulder 284 adjacent to external-drive shank 282. Drill steel 276 may additionally comprise a shaft portion 277 adjacent to shoulder 284. External-drive shank 282 and/or shoulder 284 may be directly or indirectly attached to shaft portion 277. For example, external-drive shank 282 and/or shoulder 284 may be brazed, welded, soldered, threadedly coupled, and/or otherwise adhered and/or fastened to shaft portion 277. In some embodiments, external-drive shank 282 may be integrally formed with shoulder 284, and/or shaft portion 277.

External-drive shank 282 may be configured to be coupled to a drill wrench, such as drill wrench 20. Rearward end 278 of drill steel 276 may comprise a rearward face 279. A channel 285 may be defined within drill steel 276, extending from an opening in rearward face 279 to a forward end of drill steel 276 configured to be coupled to a drill bit and/or to another drill steel. An outer peripheral surface of drill steel 276 may include one or more peripheral faces 283 extending in a generally longitudinal direction. In at least one example, a cross-section of external-drive shank 282 of drill steel 276 may comprise a generally hexagonal-shaped outer periphery that is defined by six peripheral faces 283, as illustrated in FIG. 7B. Drill steel 276 may also comprise any other shape suitable for coupling with and/or being internally and/or externally driven by a rotational member, such as drill steel 20, without limitation. In various embodiments, a cross-section of external-drive shank 282 of drill steel 276 may comprise an outer periphery having any suitable coupling and/or engagement shape, such as, for example, a generally geometric-shaped outer periphery, a generally polygonal-shaped outer periphery (e.g., a hexagonal or square shape), an uneven-shaped outer periphery, and/or a non-circular outer periphery, without limitation. In some embodiments, an exterior of external-drive shank 282 may comprise a threaded outer surface.

Figure 8:
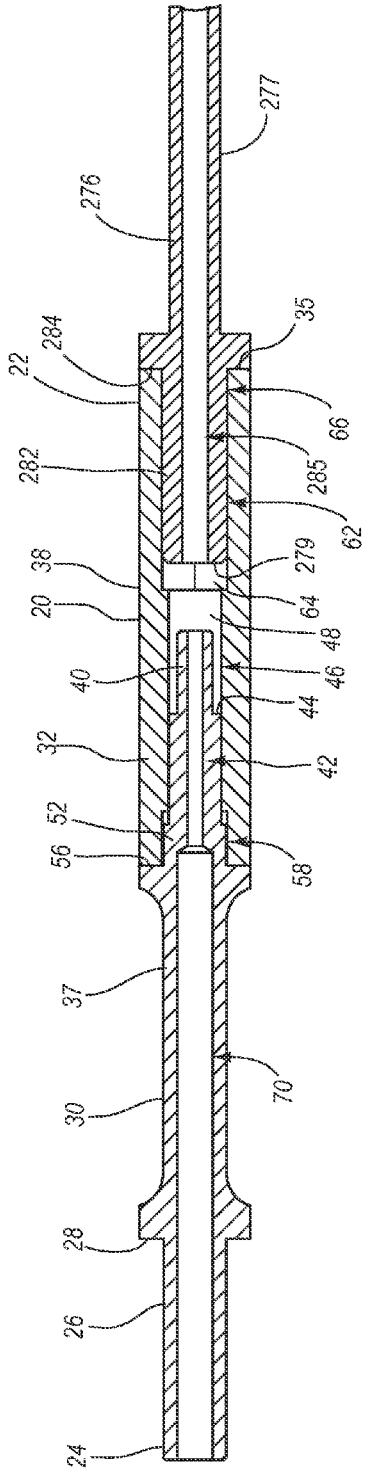
FIG. 8 is a cross-sectional side view of the exemplary drill wrench illustrated in FIG. 3A coupled to the exemplary drill steel illustrated in FIG. 7A.

FIG. 8 is a cross-sectional side view of the exemplary drill wrench 20 illustrated in FIG. 3A coupled to the exemplary drill steel 276 illustrated in FIG. 7A. As shown in FIG. 8, external-drive shank 282 of drill steel 276 may be coupled to drill wrench 20. According to at least one embodiment, external-drive shank 282 may be at least partially inserted in external-drive recess 62 defined within external drive section 61 (as illustrated in FIG. 3A) of external support member 32. In some examples, shoulder 284 may abut forward face 35 of drill wrench 20 when external-drive shank 282 is inserted in external-drive recess 62. In at least one example, forward face 35 of drill wrench 20 may exert force against shoulder 284 of drill steel 276 in a generally forward direction during drilling.

External drive section 61 may comprise a shape suitable for externally driving external-drive shank 282 of drill steel 276, without limitation. For example, a cross-section of external drive section 61 may comprise a hexagonal-shaped inner periphery configured to drive external-drive shank 282 of drill steel 76 having a corresponding hexagonal-shaped outer periphery. In various embodiments, a cross-section of drive section 61 may comprise an inner periphery having any suitable coupling and/or engagement shape, such as, for example, a generally geometric-shaped inner periphery, a generally polygonal-shaped inner periphery (e.g., a hexagonal or square shape), an uneven-shaped inner periphery, and/or a non-circular inner periphery, without limitation. In some embodiments, an interior of external drive section 61 may comprise a threaded inner surface. Accordingly, external drive section 61 of external support member 32 may engage at least a portion of external-drive shank 282 when drill wrench 20 is rotated about longitudinal axis 23.

FIG. 9 is a side view of a portion of an exemplary rotary drilling apparatus including a drill wrench 20, a drill steel 76, and a drill bit 86 that are rotated relative to a formation. As illustrated in FIG. 9, drill wrench 20 may be coupled to a drill steel 76. Additionally, a forward end 92 of drill steel 76 may be coupled to a drill bit 86. Drill bit 86 may include any suitable drill bit for cutting a formation, without limitation. For example, drill bit 86 may be configured to be used in wet-drilling and/or dry-drilling environments. Drill bit 86 may comprise any suitable cutting surfaces and/or cutting edges that are exposed to a formation during drilling. For example, drill bit 86 may comprise at least one cutting element 89. Cutting elements 89 may comprise any material or combination of materials suitable for cutting formations, without limitation. In at least one embodiment, cutting elements 89 may comprise a superhard or superabrasive material such as polycrystalline diamond (PCD).

According to at least one embodiment, one or more holes may be formed within drill bit 86. The one or more holes may extend between forward end 92 of drill steel 76 and a forward and/or side portion of drill bit 86 and may be configured to convey debris away from drill bit 86 and/or to convey drilling fluid to an exterior of drill bit 86. For example, drill bit 86 may comprise a vacuum hole 90. A passage may be defined within drill steel 76. The passage may be open to vacuum hole 90 and may extend longitudinally within drill steel 76 between forward end 92 and a rearward end 78 (as illustrated in FIG. 5A)

coupled to drill wrench 20, where the passage may be open to a passage within drill wrench 20, such as channel 42 (as illustrated in FIG. 6).

As illustrated in FIG. 9, drill bit 86 may be used to cut a borehole 88 in a formation 87. Formation 87 may comprise any suitable formation, such as, for example, a subterranean formation surrounding a mining tunnel. As shown in FIG. 9, drill wrench 20 may be directly or indirectly rotated in rotational direction $D_1$ by a suitable power unit. In various embodiments, drill wrench 20 may be rotated about longitudinal axis 23 (as illustrated in FIG. 1). As drill wrench 20 is rotated in rotational direction $D_1$, drill wrench 20 may drive drill steel 76 in rotational direction $D_1$, and drill steel 76 may likewise drive drill bit 86 in direction $D_1$. As drill wrench 20 is rotated in rotational direction $D_1$, a force may be also applied to drill wrench 20 in forward direction $D_2$, forcing drill wrench 20, drill steel 76, and drill bit 86 in direction $D_2$.

As drill bit 86 is rotated in direction $D_1$ and forced in forward direction $D_2$, cutting portions of drill bit 86, such as cutting surfaces and/or cutting edges of cutting elements 89, may be forced against formation 87. As the cutting portions of drill bit 86 are forced against formation 87, material in the form of cuttings may be removed from formation 87, thereby forming borehole 88 within formation 87. Cuttings may comprise pulverized material, fractured material, sheared material, a continuous chip, or any other form of cutting, without limitation. As cuttings are removed from formation 87, the cuttings may be directed to vacuum hole 90. For example, a vacuum assembly may be coupled directly or indirectly to an internal passage within drill wrench 20, such as channel 42 and/or channel 70 (as illustrated in FIG. 6), thereby applying a vacuum to vacuum hole 90. Accordingly, the cuttings removed from formation 87 may be channeled through drill bit 86, drill steel 76, and drill wrench 20 to the vacuum assembly.

In some examples, drill steel 76 may comprise a first drill steel used to drill borehole 88 to a first depth. Subsequently drill wrench 20 may be removed from a rearward end of the first drill steel, while leaving drill bit 86 and the first drill steel at least partially disposed with borehole 88. Any suitable second drill steel may then be coupled to rearward end 78 (as illustrated in FIG. 5A) of the first drill steel. For example, the second drill steel may comprise a drill steel configured to be externally and/or internally driven by drill wrench 20, such as drill steel 276 (as illustrated in FIG. 7A), without limitation.

Drill wrench 20 may be coupled to the rearward end of the second drill steel. As drill wrench 20 is rotated in rotational direction $D_1$ and forced in forward direction $D_2$, the first drill steel, the second drill steel, and drill bit 86 may be also driven in rotational direction $D_1$ and forced in forward direction $D_2$ by drill wrench 20. The combination of the first drill steel coupled to the second drill steel may enable drill bit 86 to drill borehole 88 to a second depth that is deeper than the first depth drilled by the first drill steel alone. According to various embodiments, more than two drill steels may also be coupled end-to-end between drill wrench 20 and drill bit 86, enabling borehole 88 to be drilled to a desired depth.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A drill wrench assembly for a rotary drilling apparatus, the drill wrench assembly comprising:

a forward end;

a rearward end longitudinally distant from the forward end;

an internal driver for driving a drill steel, the internal driver being rotatable about a longitudinal axis and shaped to fit in an internal-drive recess defined within an end of the drill steel;

an external support member configured to at least partially surround at least a portion of the drill steel when the internal driver is inserted in the internal-drive recess of the drill steel, the external support member including:

a first longitudinal section defining a first recess, the first longitudinal section extending longitudinally away from the forward end, a second longitudinal section defining a second recess, the second longitudinal section extending longitudinally away from the first longitudinal section, the second recess having a different cross-sectional shape and smaller cross-sectional size than the first longitudinal section, a third longitudinal section defining a third recess, the third longitudinal section surrounding the internal driver and extending longitudinally away from the second longitudinal section;

wherein, when the internal driver is inserted in the internal-drive recess and rotated about the longitudinal axis, the internal driver is configured to drive the drill steel by engaging at least one surface within the end of the drill steel that defines at least a portion of the internal-drive recess, and wherein the drill wrench assembly comprises a shank extending generally parallel to the longitudinal axis, the shank of the drill wrench being configured to fit within a coupling recess of a chuck.

2. The drill wrench assembly of claim 1, wherein the internal driver and the external support member are configured to simultaneously abut the drill steel when the internal driver is inserted in the internal-drive recess of the drill steel.

3. The drill wrench assembly of claim 1, wherein the internal driver and the external support member are configured to cooperatively drive the drill steel when the internal driver is inserted in the internal-drive recess of the drill steel and rotated about the longitudinal axis.

4. The drill wrench assembly of claim 3, wherein the external support member is configured to drive the drill steel by engaging an outer peripheral portion of the drill steel when the internal driver is inserted in the internal-drive recess of the drill steel and rotated about the longitudinal axis.

5. The drill wrench assembly of claim 1, further comprising a seat portion adjacent to a rearward end of the internal driver, the seat portion configured to axially abut the end of the drill steel when the internal driver is inserted in the internal-drive recess of the drill steel.

6. The drill wrench assembly of claim 1, wherein the internal driver comprises at least one outer peripheral face that extends substantially parallel to the longitudinal axis.

7. The drill wrench assembly of claim 1, wherein a cross-section of the internal driver comprises a generally hexagonal-shaped outer periphery.

8. The drill wrench assembly of claim 1, wherein the internal driver comprises a threaded outer peripheral surface.

9. The drill wrench assembly of claim 1, further comprising an internal channel defined within the internal driver, the internal channel extending through the internal driver, the internal channel being configured to open to a corresponding internal channel defined within the drill steel when the internal driver is inserted in the internal-drive recess of the drill steel.

10. The drill wrench assembly of claim 1, wherein the cross-sectional shape of the first recess defined by the first longitudinal section comprises a generally square shape.

11. The drill wrench assembly of claim 10, wherein the cross-sectional shape of the second recess defined by the second longitudinal section comprises a generally hexagonal shape.

12. The drill wrench assembly of claim 1, wherein a cross-sectional shape of the third recess defined by the third longitudinal section comprises a generally circular shape.

13. A rotary drilling apparatus for drilling formations in subterranean environments, the rotary drilling apparatus comprising:

a drill steel;

a drill bit coupled to a forward end of the drill steel;

a drill wrench coupled to a rearward end of the drill steel that is longitudinally distant from the forward end of the drill steel, the drill wrench comprising:

a forward end;

a rearward end longitudinally distant from the forward end of the drill wrench;

an internal driver that is inserted in an internal-drive recess defined within an end of the drill steel;

an external support member that at least partially surrounds at least a portion of the drill steel, the external support member including:

a first longitudinal section defining a first recess, the first longitudinal section extending longitudinally away from the forward end of the drill wrench, a second longitudinal section defining a second recess, the second longitudinal section extending longitudinally away from the first longitudinal section, the second recess having a different cross-sectional shape and smaller cross-sectional size than the first longitudinal section, a third longitudinal section defining a third recess, the third longitudinal section surrounding the internal driver and extending longitudinally away from the second longitudinal section;

wherein, when the drill wrench is rotated about the longitudinal axis, the internal driver is configured to drive the drill steel by engaging at least one surface within the end of the drill steel that defines at least a portion of the internal-drive recess, and wherein the drill wrench comprises a shank extending generally parallel to the longitudinal axis, the shank of the drill wrench being configured to fit within a coupling recess of a chuck.

14. A drill wrench for a rotary drilling apparatus, the drill wrench comprising:

a forward end;

a rearward end longitudinally distant from the forward end, the drill wrench being rotatable about a longitudinal axis extending between the forward end and the rearward end;

an internal driver including at least one engagement feature;

an external support member comprising at least one support feature that radially surrounds at least a portion of the internal driver, the external support member including:

a first longitudinal section defining a first recess, the first longitudinal section extending longitudinally away from the forward end, a second longitudinal section defining a second recess, the second longitudinal section extending longitudinally away from the first longitudinal section, the second recess having a different cross-sectional shape and smaller cross-sectional size than the first longitudinal section, a third longitudinal section defining a third recess, the third longitudinal section surrounding the internal driver and extending longitudinally away from the second longitudinal section;

wherein the third longitudinal section of the external support member defines a gap that radially surrounds at least a portion of the internal driver, and wherein the drill wrench comprises a shank extending generally parallel to the longitudinal axis, the shank of the drill wrench being configured to fit within a coupling recess of a chuck.

15. The drill wrench of claim 14, wherein the external support member comprises at least one engagement feature.

16. The drill wrench of claim 14, wherein the external support member comprises at least one generally cylindrical internal surface.

17. The drill wrench of claim 14, wherein the external support member comprises at least one internal face that extends substantially parallel to the longitudinal axis.

18. The drill wrench of claim 14, wherein the external support member is brazed to the drill wrench.

19. The drill wrench of claim 14, wherein the external support member is integrally formed with the internal driver.

* * * * *